United States Patent [19]

Liedtke et al.

[11] Patent Number: 4,946,522

[45] Date of Patent: Aug. 7, 1990

[54] LIQUID MONOPROPELLANT FOR A GUN

[75] Inventors: Larry L. Liedtke; H. Dean Mallory; William R. McBride, all of Ridgecrest; Everett M. Bens, Novato; Klaus C. Schadow; Thomas L. Boggs, both of Ridgecrest, all of Calif.

[73] Assignee: The United States of America as represented by the Secretary of the Navy, Washington, D.C.

[21] Appl. No.: 276,576

[22] Filed: Jun. 15, 1981

[51] Int. Cl.[5] ..... C06B 47/08

[52] U.S. Cl. ..... 149/36; 149/46

[58] Field of Search ..... 149/36, 46

[56] References Cited

U.S. PATENT DOCUMENTS

| | | | |
|---|---|---|---|
| 2,704,706 | 3/1955 | Audrieth | 149/36 |
| 2,978,864 | 4/1961 | Stengel | 149/36 |
| 3,219,500 | 11/1965 | Pannell et al. | 149/36 |
| 3,419,443 | 12/1968 | Bellevue | 149/36 |
| 3,706,607 | 12/1972 | Chrisp | 149/36 |
| 3,749,615 | 7/1973 | Dorsey et al. | 149/36 |
| 3,768,410 | 10/1973 | Maes et al. | 149/36 |
| 4,004,415 | 1/1977 | Wood | 149/36 |
| 4,042,431 | 8/1977 | Friant et al. | 149/36 |

*Primary Examiner*—Stephen J. Lechert, Jr.

[57] ABSTRACT

A new solution monopropellant for use in liquid propellant guns is composed of ammonium nitrate, hydrazine hydrate, and water in a mole ratio of 1:1:0.05 to 0.30.

4 Claims, 3 Drawing Sheets

LPG Operation.

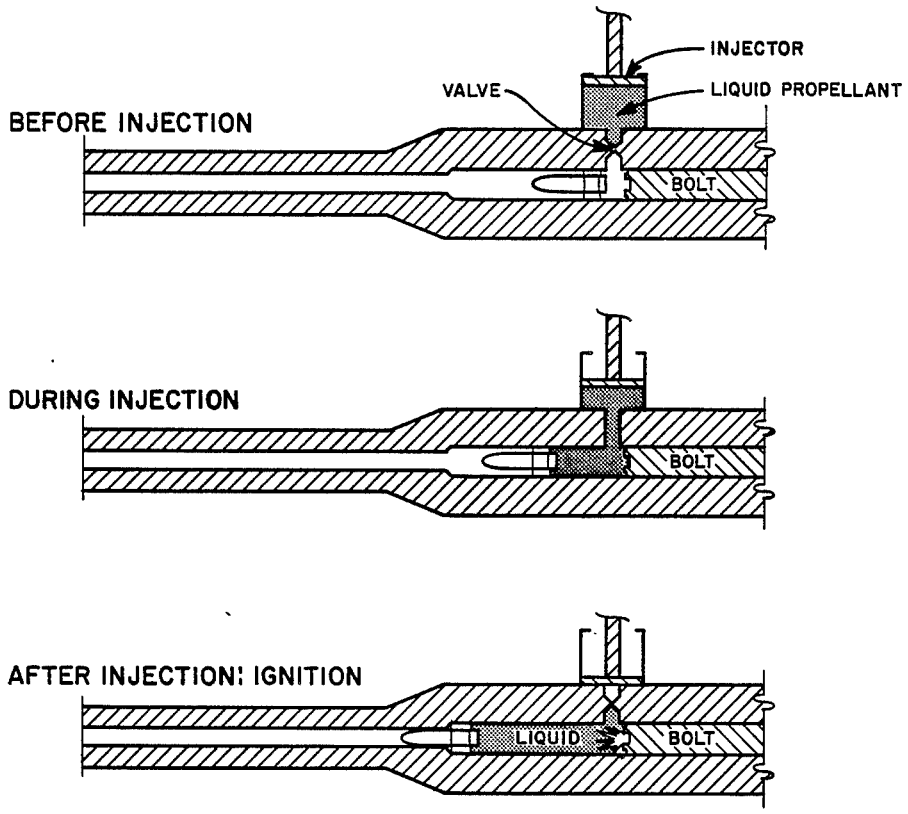
FIG. 1 LPG Operation.
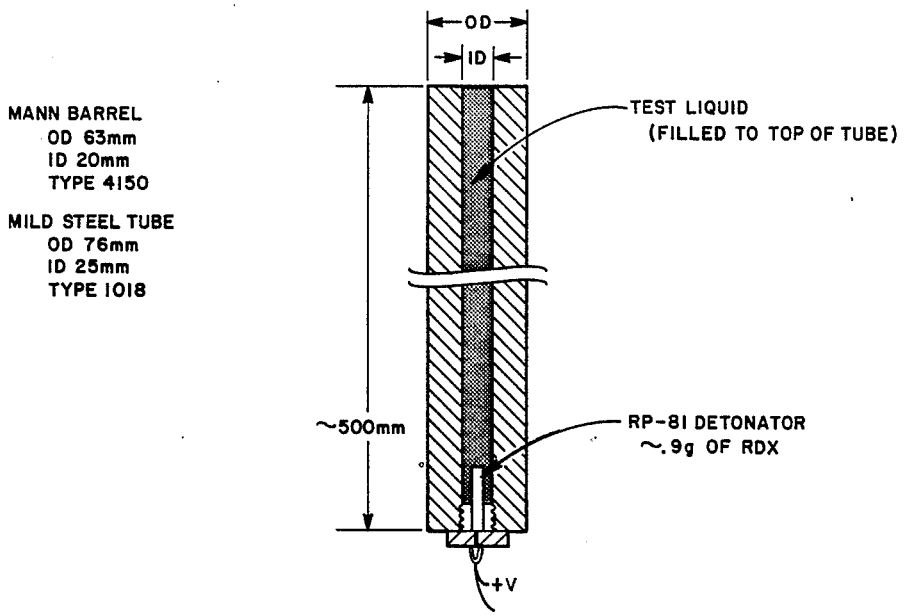
FIG. 2 Heavy Confinement Test Setup.

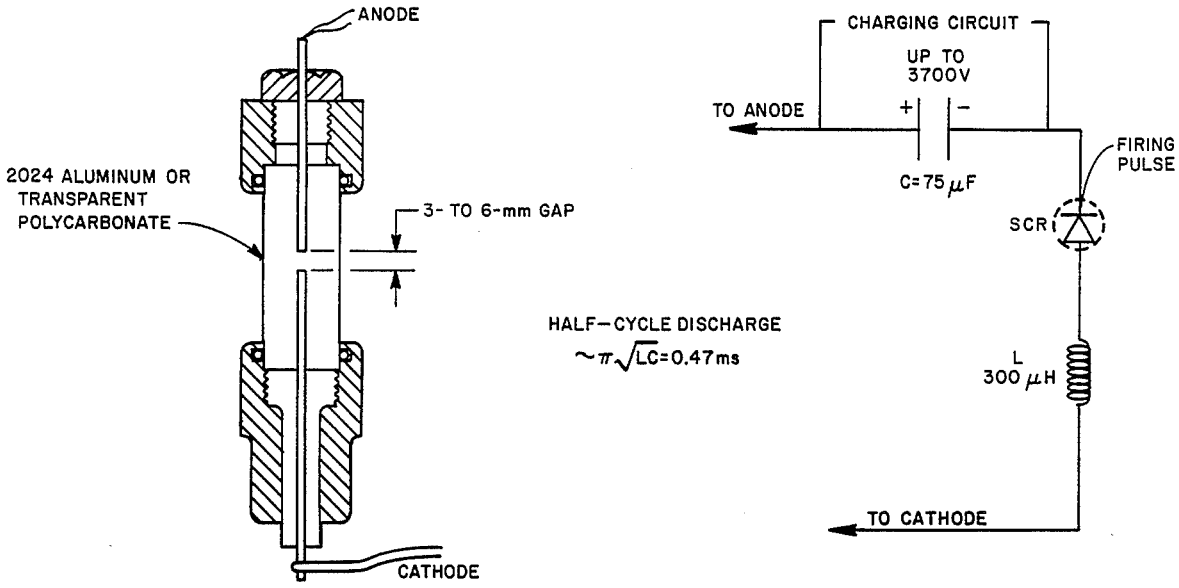
FIG. 3 LPG Ignition Apparatus
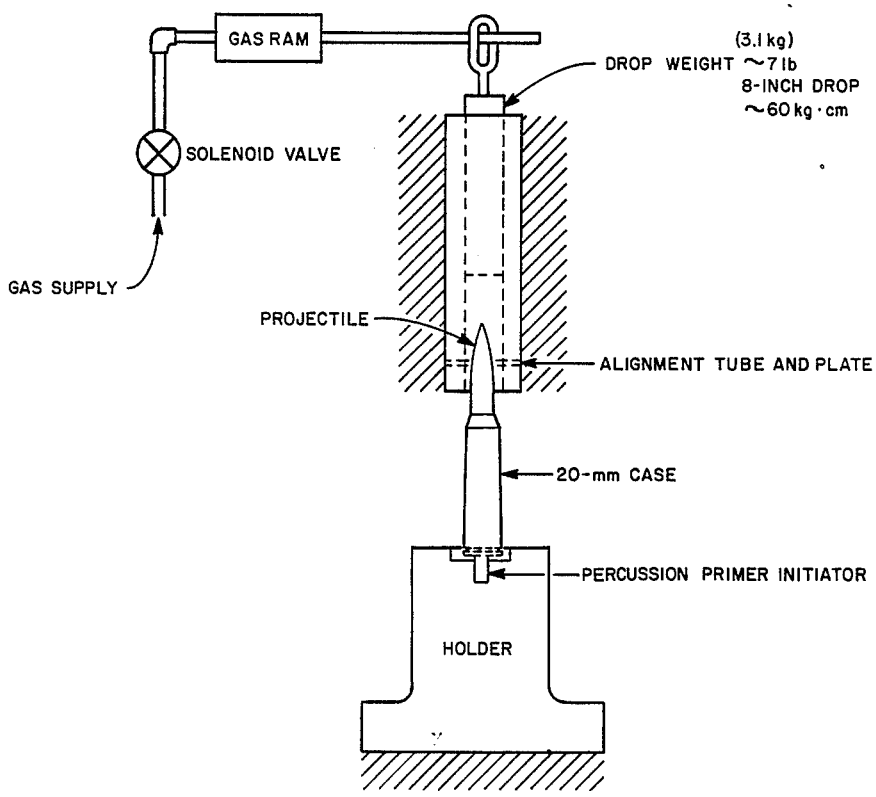
FIG. 4 20-mm Percussion Primer Ignition Test Device

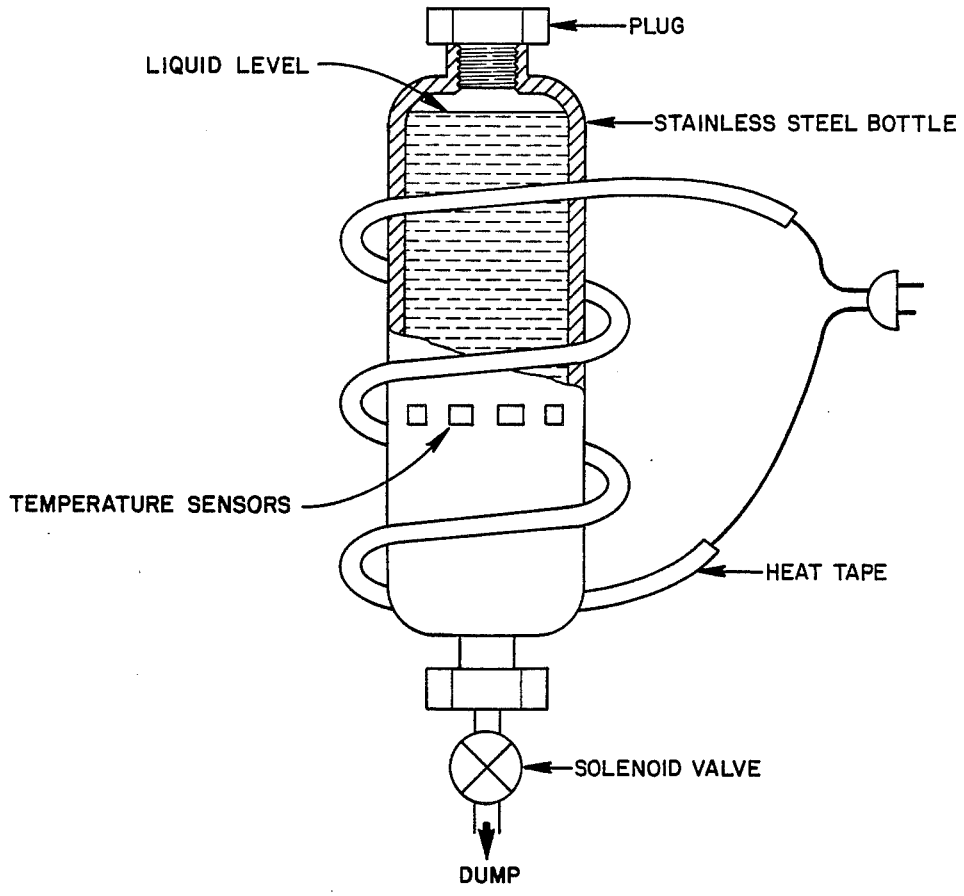
FIG. 5 Cookoff Apparatus.

LIQUID MONOPROPELLANT FOR A GUN

BACKGROUND OF THE INVENTION

1. Field of the Invention

This invention relates to propellants and more particularly to a liquid monopropellant for a gun which is derived from an oxygen-rich inorganic salt and a hydrogen-rich solvent.

2. Description of the Prior Art

The application of liquid propellants for improving gun performance has long been recognized. A bulk-loaded liquid propellant gun offers advantages of achieving higher muzzle velocities than are obtainable with solid propellant guns while minimizing size, weight, and temperature. The liquid propellant gun concept is applicable to either monopropellants or bi-propellants.

Monopropellants have the advantage of requiring only one tank, feed line, and injection system. A disadvantage has been the high detonability and explosive hazard of previous propellants. Present monopropellants are unsatisfactory for use since pressures have developed which exceed the bursting strength of the gun breech.

One prior art bi-propellant is noted in U.S. Pat. No. 4,004,415, assigned to the U.S. Navy. In this patent, two separate liquid components, contained in separate tanks, are injected into a chamber behind the projectile simultaneously; thereafter, an ignition means causes the mixed components to combust rapidly ejecting the projectile from the gun. The two components disclosed are red fuming nitric acid and various solutions of nitric acid and water in combination with n-octane.

SUMMARY OF THE INVENTION

This new propellant is selected from a new class of propellants called solution monopropellants (SMs). SMs are liquid systems of oxygen-rich salts and hydrogen-rich solvents. SMs are energetic, relatively safe, economical, and appear attractive for use in a variety of applications. For liquid propellant guns (LPG) applications, SMs must possess three characteristics: (1) insensitivity to detonation when subjected to heavy confinement, (2) good electric arc discharge ignition characteristics with smooth and repeatable pressure traces, and (3) performance exhibiting high impetus.

Of the four classes of SM families investigated, the class derived from an oxygen-rich inorganic salt-ammonium nitrate combined with a hydrogen-rich solvent-hydrazine hydrate met all of the above criteria. Emphasis was placed on the hydronitrogen compounds such as ammonia and hydrazine and their derivatives such as hydrazine hydrate and hydroxylamine. Alkyl derivatives such as methylamine, methylhydrazine, and methylazide failed to achieve an acceptable oxygen balance with the oxygen-rich salts. Hydrazine systems possessed lower theoretical performance than was expected, again because of the fuel-rich compositions. However, substitution of hydrazine hydrate for hydrazine improved the theoretical performance. The performance was also increased by the optimization of the oxygen balance in the SM, which was ascribed to the water from the hydrazine hydrate.

Although the SM is selected mainly on the basis of high specific impulse, chemical and physical characteristics such as water solubility, vapor pressure, and chemical compatibility had to be established. In addition, the safety characteristics, such as impact sensitivity and insensitivity to detonation, had to be determined.

One object of this invention is a liquid monopropellant having materials of low cost.

Another object of this invention is a liquid monopropellant having materials that are readily available.

Another object of this invention is a liquid monopropellant having components which are easily stored and mixed in the field.

Another object is a solution monopropellant with a significantly longer reaction time and higher specific impulse than achieved by prior monopropellants.

Another object is a liquid monopropellant having a low impact sensitivity.

A still further object of this invention is a liquid monopropellant which does not detonate when ignited in a confined space.

These and many other objects and advantages of the present invention will be readily apparent to one skilled in the art to which the invention pertains from a perusal of the claims and of the following description of a preferred embodiment.

DESCRIPTION OF THE PREFERRED EMBODIMENT

The new solution monopropellant consists of a solid oxidizer dissolved in a liquid fuel with water present.

The monopropellant of this invention is composed of an oxidizer, ammonium nitrate, a fuel, hydrazine hydrate, and water. The mole ratio is 1 mole of ammonium nitrate to 1 mole of hydrazine hydrate to 0.05 to 0.30 moles of water.

By varying the percentage of water, the specific impulse can be varied. The variability enhances the use of this liquid monopropellant since an optimum ratio may be selected for a particular gun design.

EXAMPLE I

Gun firing verified the outstanding properties of this new solution monopropellant. A schematic of the LPG operation is shown in FIG. 1.

The first gun firings were made with an RP-81 detonator as an ignition source. The use of the RP-81 detonator ensured strong ignition and made possible the comparison of the results of the heavy confinement tests with those of the gun firings. A standard Air Force 20 mm Mann barrel for M-50 series ammunition was used. A high pressure check value was designed for injecting the SM into the gun barrel. Four shots were fired. Only one overpressured the barrel, causing a 2 inch crack through the copper crusher gauge port. No detonations or catastrophic failures occurred. With an extended barrel, velocities in excess of a 5,000 ft/sec were obtained using an M55A2 projectile.

The detonator was reduced in size to an RP-80. Three more shots were fired and no overpressures were observed. All shots were performed at zero ullage level. During the final shot, film coverage of 20,000 pictures per second recorded projectile velocities and muzzle flash. The projectile velocity was similar to that attained with the acid-hydrocarbon bipropellant systems, confirming the theoretical high impetus of the SM. No muzzle flash was detectable under daylight conditions and with the film speed selected.

Gun firings were continued with standard 20 mm. electric primers to study internal gun ballistics and to check ullage effects on ignition and peak pressure. Five firings were made. The high muzzle energy was confirmed on all shots and was very close to LPG computer predictions. However, as has been experienced with other liquid, the amount of ullage had a pronounced effect on peak pressure and the P-t curve waveforms. A large amount of ullage caused high peak pressures. The smallest amount of ullage yielded the best P-t curves, which were similar to the curves generated in acid-hydrocarbon systems, each with one narrow peak and long plateau waveform. The P-t curves indicate a traveling high muzzle velocities. The gun retained structural integrity for all shots, including the maximum ullage of 24%. With the firing-bay lights out, only a minimal muzzle flash could be seen on the TV monitor.

EXAMPLE II

In the safety tests, the solution monopropellant of this invention showed remarkable characteristics. In drop-weight tests with an apparatus designed by the U.S. Bureau of Mines, the SM showed an impact sensitivity greater than 350 kg-cm. This indicates only a light sensitivity which is unusual for high performance monopropellants such as disclosed. The SM has energies in excess of 311,000 Ft.-lb/lb. Even more important, heavy-walled confinement tests showed that the SM is insensitive to detonation. The tests were performed in the apparatus shown in FIG. 2. The heavy-walled tubes were filled in an upright position with the propellant, and detonation was initiated by an RP-81 detonator at the plugged end. Previously, even the most insensitive propellant detonated and ruptured the tube because of its short reaction time. SM, with its long reaction time, did not damage the tube.

EXAMPLE III

Further evaluation of the SM in an LPG environment included ignition studies such as electrical ignition, percussion electrical primer ignition, and cook-off ignition and gun firings with detonators and electric primers.

Ignition by electric arc, a method desirable for LPG, was studied in the ignition apparatus shown in FIG. 3. Ignition of the SM was achieved; however, energy levels were higher than for other monopropellants. Ignition was reliable and smooth with a 350 joule, half-millisecond discharge in aluminum tubes. However, ignition could not be achieved in softer polycarbonate tubes or aluminum tubes with trapped air even with 500 joules. This indicates that ignition required maintenance of a specific pressure over a certain period of time. This pressure-time requirement was not met in tests with tubes made of softer material and containing ullage.

Ignition by percussion-electric primers used in 20 mm. projectiles was investigated with the test apparatus shown in FIG. 4. The projectile was used with an O-ring as a primary seal because of the P-t requirements that were established in the electric arc ignition studies. The O-ring arrangement in the apparatus allowed for inclusion of as much or as little ullage as desired. The results of these tests confirmed the P-t requirements. With zero to 50% ullage, strong ignition was achieved. With 75% ullage, the SM failed to ignite because of insufficient gas pressure generation by the 20 mm. primer. In the past small variations of ullage have been the Pandora's box of liquid monopropellant ignition.

Cookoff ignition, not a desirable form of ignition, was investigated because it may occur in hot gun chambers. Information on cookoff ignition is also necessary for safety considerations. A 250 $cm.^3$ stainless steel bottle was filled almost to the top with the SM and then capped and heated for 30 minutes to a maximum temperature of 300° F. The apparatus utilized is shown in FIG. 5. The SM was held at this temperature for an additional 10 minutes and then dumped. There was no adverse reaction.

In use, the components can be shipped separately to the place of use. The components are then mixed in a desired molar ratio depending upon the operational requirements. This mixture is then pumped into the desired container for use. Subsequently it is pumped from the container into the gun breech for ignition.

We claim:

1. A method for propelling a projectile from a gun wherein a liquid monopropellant is injected into a chamber behind the projectile and ignited, the improvement residing in utilizing the liquid monopropellant consisting of ammonium nitrate, hydrazine hydrate, and water.

2. A method for propelling a projectile according to claim 1, wherein the mole ratio of ammonium nitrate to hydrazine hydrate to water is 1:1:0.05 to 0.30.

3. A liquid monopropellant consisting of hydrazine hydrate, ammonium nitrate and water.

4. A liquid monopropellant according to claim 3, wherein the mole ratio of ammonium nitrate to hydrazine hydrate to water is 1:1:0.05 to 0.30.

* * * * *